US011613397B2

(12) United States Patent
Delagrange et al.

(10) Patent No.: US 11,613,397 B2
(45) Date of Patent: Mar. 28, 2023

(54) RING PULL CAP RIM FOR GLASS CONTAINERS

(71) Applicant: Owens-Brockway Glass Container Inc., Perrysburg, OH (US)

(72) Inventors: Donald P Delagrange, Lambertville, MI (US); Raul M. Paredes, Perrysburg, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 217 days.

(21) Appl. No.: 16/569,082

(22) Filed: Sep. 12, 2019

(65) Prior Publication Data

US 2021/0078753 A1 Mar. 18, 2021

(51) Int. Cl.
*B65D 1/02* (2006.01)
*B65D 41/12* (2006.01)

(52) U.S. Cl.
CPC ..... *B65D 1/0246* (2013.01); *B65D 41/12* (2013.01)

(58) Field of Classification Search
CPC .... B65D 41/10; B65D 41/17; B65D 41/0457; B65D 7/285; B65D 1/023; B65D 1/10; B65D 1/0246
USPC ..... 215/44, 45, 322, 323, 324
See application file for complete search history.

(56) References Cited

U.S. PATENT DOCUMENTS 729,475 A 5/1903 Wilson
1,127,687 A 2/1915 Slattengren
1,163,039 A * 12/1915 Schmitt ..... B65D 41/42 215/254
1,582,681 A * 4/1926 Hammer ..... B65D 1/0246 215/43
1,752,291 A * 4/1930 Barbiers ..... B65D 1/10 215/382
D110,817 S 8/1938 McQuinn
2,629,509 A * 2/1953 Boschin ..... B65D 1/10 215/45
2,778,520 A 1/1957 Hyde, Jr.
2,817,453 A 12/1957 Stover
(Continued)

FOREIGN PATENT DOCUMENTS

CN 201169417 Y 12/2008
DE 863443 C 1/1953
(Continued)

OTHER PUBLICATIONS

International Search Report and Written Opinion, Int. Serial No. PCT/US2020/050437, Int. Filing Date: Sep. 11, 2020, Applicant: Owens-Brockway Glass Container Inc., dated Feb. 3, 2021.

*Primary Examiner* — Anthony D Stashick
*Assistant Examiner* — Raven Collins

(57) ABSTRACT

A glass container includes a sidewall circumscribing a central longitudinal axis, and including a neck finish, which includes a wall having a radially inner surface and a radially outer surface and a rim extending from the wall. The rim has a sealing lip, an outward lip, and a retention lip extending between the outward lip and the radially outer surface of the wall. A ratio of a radial thickness of the rim at a major outer diameter of the outward lip of the rim to a radial thickness of the neck finish wall below the rim and between the radially inner and outer surfaces is between 1.9:1 and 2.2:1. A package includes the glass container and a ring pull cap closure coupled to the rim.

20 Claims, 2 Drawing Sheets

(56) References Cited

U.S. PATENT DOCUMENTS

| | | | | |
|---|---|---|---|---|
| 3,013,687 | A | 12/1961 | Gould | |
| D200,820 | S | 4/1965 | Biakslee | |
| D202,003 | S | 8/1965 | Livingston | |
| 3,217,916 | A * | 11/1965 | Wallace | B65D 41/42 D9/438 |
| 3,398,847 | A | 8/1968 | Towns | |
| 3,559,833 | A | 2/1971 | Alonso | |
| 3,591,031 | A | 7/1971 | Evanston, III | |
| 3,630,405 | A | 12/1971 | Podesta | |
| 3,823,841 | A | 7/1974 | Lovejoy | |
| 3,834,573 | A | 9/1974 | Amos | |
| 3,845,872 | A | 11/1974 | Towns et al. | |
| 3,902,619 | A | 9/1975 | Gouget | |
| 3,985,255 | A | 10/1976 | Blair | |
| 4,066,180 | A | 1/1978 | Sanchez | |
| D270,140 | S | 8/1983 | Berglund | |
| D270,521 | S | 9/1983 | Morris | |
| 4,444,325 | A | 4/1984 | Lecinski, Jr. | |
| D274,792 | S | 7/1984 | Price | |
| D276,598 | S | 12/1984 | Bagwell | |
| D281,584 | S | 12/1985 | Berglund | |
| 4,605,137 | A | 8/1986 | Taragna et al. | |
| 4,605,138 | A | 8/1986 | Taragna et al. | |
| 4,927,048 | A | 5/1990 | Howard | |
| D308,828 | S | 6/1990 | Magnusson | |
| D310,031 | S | 8/1990 | Curasi | |
| D319,017 | S | 8/1991 | Turner et al. | |
| D332,919 | S | 2/1993 | Turnbull et al. | |
| 5,383,565 | A | 1/1995 | Luch | |
| D359,451 | S | 6/1995 | Dees | |
| D425,422 | S | 5/2000 | David | |
| 6,102,225 | A | 8/2000 | Lynn | |
| D469,353 | S | 1/2003 | Sturk | |
| D490,708 | S | 6/2004 | Lown | |
| 6,866,158 | B1 * | 3/2005 | Sommer | B29C 67/246 215/12.1 |
| 7,036,671 | B2 | 5/2006 | Hidalgo et al. | |
| D583,230 | S | 12/2008 | Maze et al. | |
| D584,613 | S | 1/2009 | Yan et al. | |
| D587,137 | S | 2/2009 | Hayden et al. | |
| D593,876 | S | 6/2009 | Hayden et al. | |
| D596,048 | S | 7/2009 | Hayden et al. | |
| D596,502 | S | 7/2009 | Diss et al. | |
| D596,505 | S | 7/2009 | Diss et al. | |
| D601,436 | S | 10/2009 | Stephens et al. | |
| D621,705 | S | 8/2010 | Breckan | |
| D621,707 | S | 8/2010 | Breckan | |
| 7,878,354 | B2 | 2/2011 | Chae | |
| 7,931,163 | B2 | 4/2011 | Von Spreckelsen et al. | |
| D641,261 | S | 7/2011 | Diss et al. | |
| D644,537 | S | 9/2011 | Hu | |
| D646,971 | S | 10/2011 | Chmela | |
| D650,703 | S | 12/2011 | Westphal | |
| D663,210 | S | 7/2012 | Diss et al. | |
| D675,527 | S | 2/2013 | Rogers et al. | |
| D676,745 | S | 2/2013 | MacNeill et al. | |
| D676,746 | S | 2/2013 | Shaffer et al. | |
| D676,751 | S | 2/2013 | Coyne et al. | |
| D684,483 | S | 6/2013 | Jahina et al. | |
| D687,301 | S | 8/2013 | Topinka et al. | |
| 8,616,400 | B2 | 12/2013 | Persson et al. | |
| D707,568 | S | 6/2014 | Stephens et al. | |
| D707,569 | S | 6/2014 | Stephens et al. | |
| D708,523 | S | 7/2014 | Topinka et al. | |
| D708,943 | S | 7/2014 | Van Goolen | |
| D722,273 | S | 2/2015 | Ivie | |
| 9,114,899 | B2 | 8/2015 | Jouin et al. | |
| 9,211,967 | B2 | 12/2015 | Ungrady et al. | |
| D766,721 | S | 9/2016 | Meador | |
| 9,758,294 | B2 | 9/2017 | McDaniel et al. | |
| D799,318 | S | 10/2017 | Wei | |
| D801,811 | S | 11/2017 | Wei | |
| D801,812 | S | 11/2017 | Wei | |
| 9,856,059 | B2 | 1/2018 | Grant | |
| D810,564 | S | 2/2018 | Wei | |
| D839,727 | S | 2/2019 | Wei | |
| D840,224 | S | 2/2019 | Wei | |
| 2002/0027122 | A1 | 3/2002 | Herrera | |
| 2006/0060554 | A1 | 3/2006 | Garman | |
| 2006/0108315 | A1 | 5/2006 | Britton | |
| 2006/0131254 | A1 | 6/2006 | Perez | |
| 2006/0238338 | A1 * | 10/2006 | Nanda | B65D 41/34 340/540 |
| 2006/0283827 | A1 | 12/2006 | Perez et al. | |
| 2007/0175855 | A1 * | 8/2007 | Penny | B29B 11/14 215/383 |
| 2009/0206079 | A1 | 8/2009 | Valderrama Chaparro | |
| 2009/0250427 | A1 | 10/2009 | Strout et al. | |
| 2015/0375887 | A1 | 12/2015 | Van Dijck et al. | |
| 2017/0121047 | A1 | 5/2017 | Marina et al. | |
| 2018/0257838 | A1 * | 9/2018 | Chisholm | B65D 77/2032 |
| 2018/0370673 | A1 | 12/2018 | Taruno et al. | |
| 2019/0168904 | A1 | 6/2019 | Arregui Letamendi | |

FOREIGN PATENT DOCUMENTS

| | | | |
|---|---|---|---|
| DE | 2630022 | C2 | 1/1977 |
| DE | 2827307 | A1 | 1/1979 |
| EP | 0020250 | A1 | 12/1980 |
| FR | 1378912 | A | 11/1964 |
| WO | 2016026308 | A1 | 2/2016 |

* cited by examiner

RING PULL CAP RIM FOR GLASS CONTAINERS

The disclosure relates to glass containers generally and, more particularly, to glass containers having beaded neck finishes.

BACKGROUND

A wide mouth glass container typically has a neck finish with an outer diameter greater than 38 mm. Some wide mouth glass containers have beaded neck finishes that receive foil closures, for example, as disclosed in U.S. Pat. No. 9,856,059. Other wide mouth glass containers have outwardly flared neck finishes to receive metal ring pull caps, for instance, as disclosed in U.S. Pat. No. 3,561,631. And despite the popularity of ring pull cap closures for use with narrow neck bottles, such closures have not been successfully implemented for wide mouth glass containers. A ring pull cap closure includes a metal base wall, a metal skirt for crimping to a container rim, a polymeric annular seal carried by the metal base wall proximate the metal skirt, and a metal pull ring extending from one side of the skirt and having lateral edges coinciding with weakenings in the skirt and the base wall. After the ring pull cap closure is coupled to the container rim by bottle capping equipment in a bottling plant, a user may remove the closure by placing a finger through the pull ring, pulling radially outwardly and then axially upwardly to rip the handle away from the skirt and the base wall along the weakenings, and then continuing to pull on the pull ring until the closure is removed from the container. Such closures have not been successfully deployed for glass containers because it has been difficult to produce a beaded neck finish for a glass container that satisfies pressure and removal force specifications for ring pull cap closures but also feels good to a consumer and is manufacturable without significant commercial variations.

BRIEF SUMMARY OF THE DISCLOSURE

In accordance with an embodiment of the present disclosure, a glass container includes a base and a sidewall extending away from the base, circumscribing a central longitudinal axis, and including a neck finish terminating the side wall. The neck finish includes a wall having a radially inner surface and a radially outer surface, and a rim extending from the wall and terminating the neck finish. The rim has a sealing lip facing axially outwardly and extending substantially perpendicular to the central longitudinal axis, an outward lip facing radially and axially outwardly, a retention lip facing axially inwardly and radially outwardly and extending between the outward lip and the radially outer surface of the wall, a first rounded surface extending between the sealing lip and the outward lip, and a second rounded surface extending between the outward lip and the retention lip. A filleted surface extends between the retention lip and the radially outer surface of the wall. A ratio of a radial thickness of the rim at a major outer diameter of the outward lip of the rim to a radial thickness of the wall of the neck finish below the rim and between the radially inner and outer surfaces is between 1.9:1 and 2.2:1.

DETAILED DESCRIPTION

In general, the present disclosure is directed to a glass container having a neck finish uniquely configured for use with a ring pull cap closure for favorable manufacturability of the glass container and acceptable pressurization and retention performance of the glass container in conjunction with the closure. The configuration of the neck finish also may provide good lip feel to a consumer when the consumer drinks a beverage from the container.

Figure 1A:
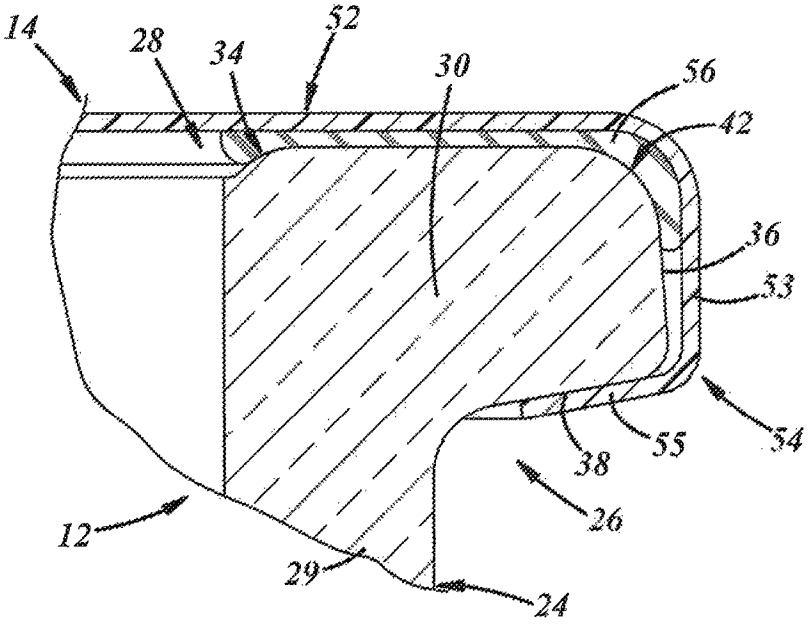
FIG. 1A is an enlarged, fragmentary, cross-sectional side view of the package of FIG. 1, taken from circle 1A of FIG. 1.
Figure 1:
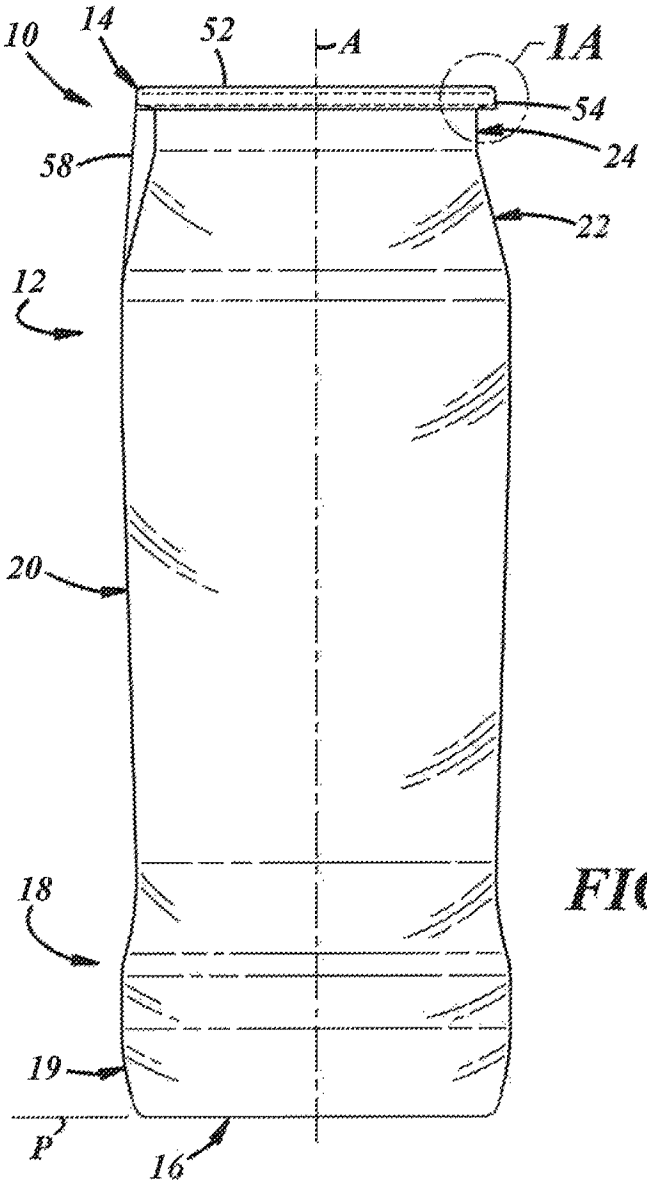
FIG. 1 is a perspective view of a package in accordance with an illustrative embodiment of the present disclosure and including a container and a ring pull cap closure applied thereto.

Referring now specifically to FIG. 1, a package 10 includes a glass container 12 and a ring pull cap closure 14 coupled to the container 12. The package 10 may be used for packaging of food, beverages, or any other product suitable for use with a glass container. In the illustrated embodiment, the container 12 may include a beverage container. In other embodiments, the container 12 may include ajar, bowl, cup, or any other container suitable for accepting the ring pull cap closure 14.

In any embodiment, the container 12 includes a base 16 that establishes a base plane P that may be normal or perpendicular to a central longitudinal axis A of the container 12. The base 16 need not be entirely flat and may include a push-up or punt (not shown). Also, the container 12 includes a sidewall 18 extending away from the base 16 and circumscribing the axis A. In the illustrated beverage container embodiment, the sidewall 18 includes an insweep 19 extending away from the base 16, a body 20 extending away from the insweep 19, a shoulder 22 extending away from the body 20, and a neck 24 extending away from the shoulder 22.

With reference to FIG. 1A, the neck 24 may be cylindrical and has a neck finish 26 that terminates the sidewall 18 and that establishes an open mouth 28 of the container 12. The neck finish 26 is what is known in the art as a "bead finish" and is not a crown finish or a threaded finish. The neck finish 26 includes a wall 29 that may be cylindrical, and a bead or rim 30 that extends from the wall 29 and protrudes radially outwardly with respect to the wall 29 and terminates the neck finish 26.

Figure 2:
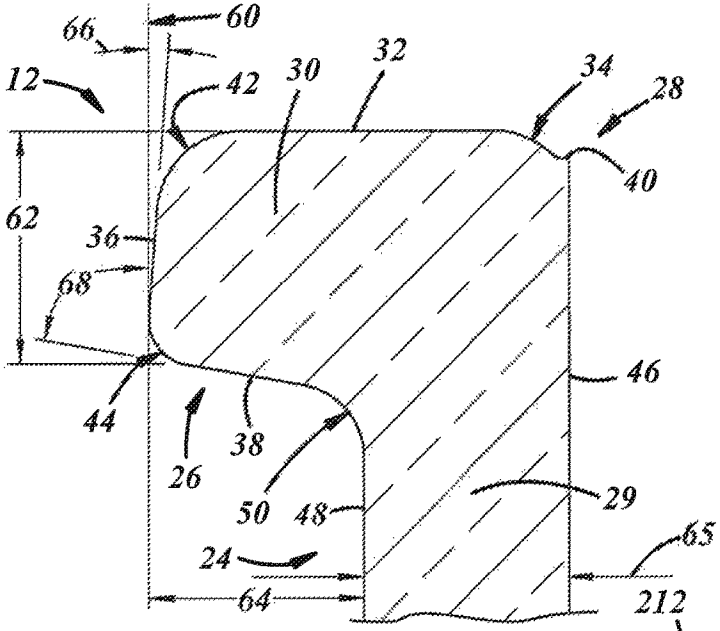
FIG. 2 is an enlarged, fragmentary, cross-sectional side view of a beaded neck finish of the glass container of FIGS. 1 and 1A.

With reference to FIG. 2, the rim 30 includes a sealing lip 32 that is an axially outwardly facing surface, a mouth transition lip 34 that is a radially inwardly and axially outwardly facing surface, an outward lip 36 that is a radially and axially outwardly facing surface, and a retention lip 38 that is a radially outwardly and axially inwardly facing surface or undersurface. The sealing lip 32 extends between the mouth transition and outward lips 34, 36, and is substantially perpendicular to the axis A. As used herein, the term "substantially" in reference to angular degrees means plus or minus less than two angular degrees. The mouth transition lip 34 may be excurvately radiused or rounded as shown in the illustrated embodiment, and/or may be straight-tapered in other embodiments. Also, the mouth transition lip 34 may extend radially inwardly of the sealing lip 32, between the sealing lip 32 and the inner open mouth 28 of the container 12, with or without a step 40 therebetween. The outward lip 36 is tapered to extend at an oblique angle with respect to the central longitudinal axis A and, likewise, the retention lip 38 is tapered to extend at an oblique angle with respect to the central longitudinal axis A. The rim 30 also includes an upper, or first, outer rounded surface 42 that extends between the outward lip 36 and the intermediate surface 38, and a lower, or second, outer rounded surface 44 that extends between the outward lip 36 and the retention lip 38 of the rim 30.

With continued reference to FIG. 2, the neck finish 26 also includes a radially inner surface 46, which may be cylindrical, and terminates at the open mouth 28 of the container 12. Also, the neck finish 26 includes a radially outer surface 48, which may be cylindrical, and extends below the rim 30. Further, the neck finish 26 includes a filleted surface 50 extending between the radially outer surface 48 and the retention lip 38. Those of ordinary skill in the art will appreciate that the filleted surfaces 50 and rounded surfaces 42, 44 are also known as "fillets" of incurvate shape and "rounds" of excurvate shape.

With reference to FIGS. 1 and 1A, the closure 14 includes a metal base wall 52, a metal skirt 54 for crimping to the container rim 30, a polymeric annular seal 56 (FIG. 1A) carried by the metal base wall 52 proximate the metal skirt 54, and a metal pull ring 58 (FIG. 1) extending from one side of the skirt 54 and having lateral edges (not shown) coinciding with weakenings (not shown) in the skirt 54 and the base wall 52. The skirt 54 includes a cylindrical portion 53 surrounding the outward lip 36 of the rim 30 of the container 12, and a crimped portion 55 overlapping at least a portion of the retention lip 38 of the rim 30 of the container 12. The cylindrical portion 53 may be spaced apart from the outward lip 36, whereas the crimped portion 55 may be in direct contact with the retention lip 38. The metal of the closure 14 may be aluminum, or any other material suitable for coupling to glass and being torn. The polymeric material of the closure 14 may be polyethylene, or any other material suitable for sealing between a metal closure and a glass container. In assembly, the seal 56 may extend from the mouth transition lip 34, over the sealing lip 32 and the upper outer rounded surface 42, and to the outward lip 36.

With reference again to FIG. 2, the container rim 30 is configured for commercially successful use with ring pull cap closures, such that the configuration facilitates acceptable pressurization and retention performance of the glass container 12 in conjunction with ring pull cap closures, and facilitates manufacturability of the glass container 12. The rim configuration also may provide good lip feel to a consumer who drinks from the glass container 12. More specifically, the rim 30 may be shaped, sized, and/or proportioned to provide such results, according to one or more of the following ratios, angles, or proportions. First, a ratio of a radial thickness 64 and 65 of the rim 30 at the major outer diameter 60 to a radial thickness 65 of the wall 29 of the neck finish 26 below the rim 30 and between the radially inner and outer surfaces 46, 48 is 2:1. Second, a ratio of a major outer diameter 60 of the outward lip 36 of the rim 30 relative to the inner diameter of the radially inner surface 46 of the neck finish 26 may be 1.2:1. Third, a ratio of the major outer diameter 60 of the outward lip 36 relative to an outer diameter of the radially outer surface 48 of the neck finish 26 may be 1.05:1. Fourth, a ratio of an axial thickness 62 of the rim 30 measured between the sealing lip 32 and the intersection of the retention lip 38 and the lower outer rounded surface 44 at the major outer diameter 60 of the rim 30 relative to the radial thickness 64 of the rim 30 between the major outer diameter 60 of the outward lip 36 and the outer diameter of the radially outer surface 48 of the neck finish 26 may be 1:1. Stated another way, a ratio of an axial height of the outward lip 36 of the rim 30 and the first and second rounded surfaces 42, 44 relative to a radial width of the retention lip 38 and the second rounded surface 44 and the filleted surface 50 may be 1:1. Fifth, the outward lip 36 of the rim 30 may have a straight taper disposed at an outward angle 66 of four degrees with respect to an axis parallel to the longitudinal axis A. Sixth, the retention lip 38 of the rim 30 may have a straight taper disposed at a retention angle 68 of eighty (80) degrees with respect to an axis parallel to the longitudinal axis A. Seventh, the mouth transition lip 34 may have a radius of 1.9% of the major outer diameter 60 of the outward lip 36. Eighth, the first rounded surface 42 may have a radius of 1.9% of the major outer diameter 60 of the outward lip 36. Ninth, the second or lower rounded surface 44 may have a radius of 1% of the major outer diameter 60 of the outward lip 36. Tenth, the filleted surface 50 may have a radius of 1.6% of the major outer diameter 60 of the outward lip 36.

Figure 3:
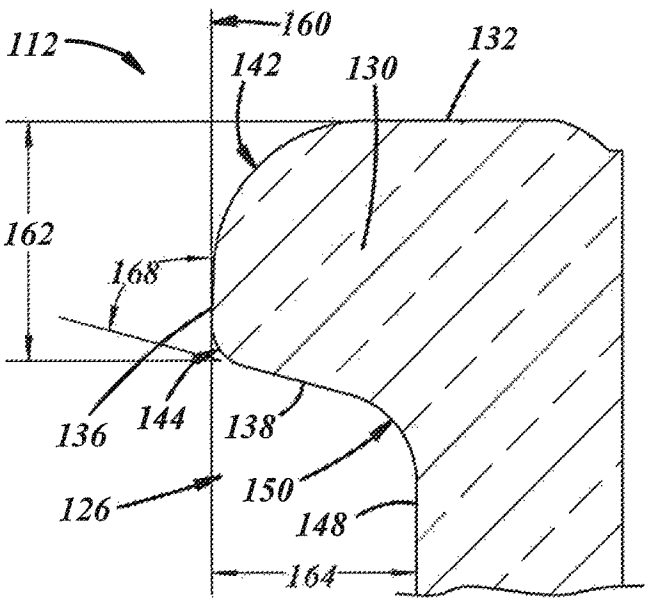
FIG. 3 is an enlarged, fragmentary, cross-sectional side view of a beaded neck finish of a glass container in accordance with another illustrative embodiment of the present disclosure.
Figure 4:
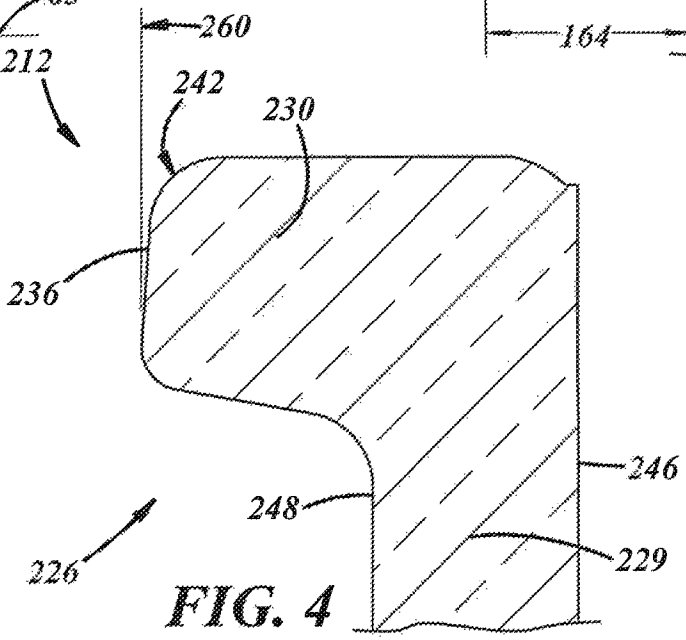
FIG. 4 is an enlarged, fragmentary, cross-sectional side view of a beaded neck finish of a glass container in accordance with a further illustrative embodiment of the present disclosure.

With reference to FIG. 3, a container 112 includes a container rim 130 in accordance with another illustrative embodiment that is also shaped, sized, and/or proportioned to provide good results, and is nearly identical to the rim 30 of FIG. 2, with the following exceptions. First, a ratio of an axial thickness 162 of the rim 130 measured between a sealing lip 132 and the intersection of the retention lip 138 and the lower outer rounded surface 144 at a major outer diameter 160 of the outward lip 136 of the rim 130 relative to a radial thickness 164 of the rim 130 between the major outer diameter 160 of the outward lip 136 of the rim 130 and the outer diameter of a radially outer surface 148 of the neck finish 126 may be 1.1:1. Second, a retention lip 138 of the rim 130 may have a straight taper disposed at a retention angle 168 of 75 degrees with respect to an axis parallel to the longitudinal axis A. Third, a first rounded surface 142 may have a radius of 3.1% of the major outer diameter 160 of the outward lip 136. Fourth, a filleted surface 150 may have a radius of 1.9% of the major outer diameter 160 of the outward lip 136. With reference to FIG. 4, a container 212 includes a container rim 230 in accordance with another illustrative embodiment that is also shaped, sized, and/or proportioned to provide good results, and is nearly identical to the rims 30, 130 of FIGS. 2 and 3, with the following exceptions. First, a ratio of the radial thickness 64 (FIG. 1) or 164 (FIG. 2), and 65 (FIG. 1), of the rim 230 at a major outer diameter 260 of an outward lip 236 of the rim 230 to the radial thickness 65 (FIG. 1) of a wall 229 of the neck finish 226 below the rim 230 and between the radially inner and outer surfaces 246, 248 is 2.1:1. Second, a first rounded surface 242 may have a radius of 1.6% of a major outer diameter 260 of the outward lip 236.

According to the present disclosure, the containers 12, 112, 212 include container rims 30, 130, 230 that may be shaped, sized, and/or proportioned according to one or more of the following ratios, angles, or proportions. First, a ratio of radial thicknesses 64 (FIG. 1), or 164 (FIG. 2), and 65 (FIG. 1), of the rims 30, 130, 230 at the major outer diameters 60, 160, 260 to the radial thicknesses 65 (FIG. 1) of the neck finishes 26, 126, 226 below the rims 30, 130, 230 between the radially inner and outer surfaces 46, 48, 148, 246, 248 is between 1.9:1 and 2.2:1 including all ranges, subranges, values, and endpoints thereof. Second, a ratio of major outer diameters 60, 160, 260 of the outward lips 36, 136, 236 of the rims 30, 130, 230 relative to inner diameters of the radially inner surfaces 46, 146, 246 is between 1.1:1 and 1.3:1 including all ranges, subranges, values, and endpoints thereof. Third, a ratio of the major outer diameters 60, 160, 260 of the outward lips 36, 136, 236 of the rims 30, 130, 230 relative to outer diameters of the radially outer surfaces 48, 148 of the neck finishes 26, 126 is between 1.03:1 and 1.07:1 including all ranges, subranges, values, and endpoints thereof. Fourth, a ratio of axial thicknesses 62, 162 of the rims 30, 130, 230 measured between the sealing lips 32, 132 and the intersection of the retention lips 38, 138 and the lower outer rounded surfaces 44, 144 at the major outer diameters 60, 160, 260 of the outward lips 36, 136, 236 of the rims 30, 130, 230 relative to radial thicknesses 64, 164 of the rims 30, 130, 230 between the major outer diameters 60, 160, 260 of the outward lips 36, 136, 236 of the rims 30, 130, 230 and outer diameters of the radially outer surfaces 48, 148 is between 0.9:1 and 1.2:1 including all ranges, subranges, values, and endpoints thereof. Fifth, the outward lips 36, 136, 236 of the rims 30, 130, 230 have a straight taper disposed at an angle between two and six degrees with respect to an axis parallel to the longitudinal axis A including all ranges, subranges, values, and endpoints of that range. Sixth, the retention lips 38, 138 of the rims 30, 130, 230 have a straight taper disposed at an angle between 68 and 87 degrees with respect to an axis parallel to the longitudinal axis A including all ranges, subranges, values, and endpoints of that range. Seventh, the mouth transition lips 34 may have a radius between 1.6% and 2.2% of the major outer diameter 60 of the outward lips 36, 136, 236. Eighth, the first rounded surfaces 42, 142, 242 may have a radius between 1.3% and 3.4% of the major outer diameters 60, 16, 260 of the outward lips 36, 136, 236 including all ranges, subranges, values, and endpoints of that range. Ninth, the second or lower rounded surfaces 44, 144 may have a radius between 0.9% and 1.1% of the major outer diameters 60, 160, 260 of the outward lips 36, 136, 236 including all ranges, subranges, values, and endpoints of that range. Tenth, the filleted surfaces 50, 150 may have a radius between 1.3% and 2.2% of the major outer diameters 60, 160, 260 of the outward lips 36, 136, 236 including all ranges, subranges, values, and endpoints of that range.

The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A glass container, comprising:

a base; and a sidewall extending away from the base, circumscribing a central longitudinal axis, and including a beaded neck finish terminating the side wall, wherein the beaded neck finish includes:

a wall having a radially inner surface and a radially outer surface;

a rim extending from the wall and terminating the beaded neck finish and having:

a sealing lip facing axially outwardly and extending substantially perpendicular to the central longitudinal axis, an outward lip facing radially and axially outwardly, a retention lip facing axially inwardly and radially outwardly and extending between the outward lip and the radially outer surface of the wall, a first rounded surface extending between the sealing lip and the outward lip, and a second rounded surface extending between the outward lip and the retention lip; and a filleted surface extending between the retention lip and the radially outer surface of the wall, wherein a ratio of a radial thickness of the rim at a major outer diameter of the outward lip of the rim to a radial thickness of the wall of the beaded neck finish below the rim and between the radially inner and outer surfaces is between 1.9:1 and 2.2:1.

2. The glass container set forth in claim 1 wherein a ratio of the major outer diameter relative to an inner diameter of the radially inner surface is between 1.1:1 and 1.3:1.

3. The glass container set forth in claim 1 wherein a ratio of the major outer diameter relative to an outer diameter of the radially outer surface of the beaded neck finish is between 1.03:1 and 1.07:1.

4. The glass container set forth in claim 1 wherein a ratio of an axial thickness of the rim at the major outer diameter relative to a radial thickness of the rim between the major outer diameter and an outer diameter of the radially outer surface is between 0.9:1 and 1.2:1.

5. The glass container set forth in claim 1 wherein the outward lip of the rim has a straight taper disposed at an angle between two and six degrees with respect to an axis parallel to the longitudinal axis.

6. The glass container set forth in claim 1 wherein the retention lip of the rim has a straight taper disposed at an angle between 68 and 87 degrees with respect to an axis parallel to the longitudinal axis.

7. The glass container set forth in claim 1 wherein the rim of the beaded neck finish also includes a mouth transition lip extending radially inwardly of the sealing lip and having a radius between 1.6% and 2.2% of the major outer diameter.

8. The glass container set forth in claim 1 wherein the first rounded surface has a radius between 1.3% and 3.4% of the major outer diameter.

9. The glass container set forth in claim 1 wherein the second rounded surface has a radius between 0.9% and 1.1% of the major outer diameter.

10. The glass container set forth in claim 1 wherein the filleted surface has a radius between 1.3% and 2.2% of the major outer diameter.

11. The glass container set forth in claim 1 wherein the container is a glass beverage container.

12. A package comprising:

the glass container set forth in claim 1; and a ring pull cap closure coupled to the rim.

13. The package set forth in claim 12 wherein the ring pull cap closure includes a metal outer portion and a polymeric inner portion, wherein the metal outer portion includes a base wall, and a skirt wall extending from the base wall and including a cylindrical portion spaced from and surrounding the outward lip and a crimped portion overlapping and contacting at least a portion of the retention lip.

14. A glass container, comprising:

a base; and a sidewall extending away from the base, circumscribing a central longitudinal axis, and including a neck finish terminating the side wall, wherein the neck finish includes:

a wall having a radially inner surface and a radially outer surface;

a rim extending from the wall and terminating the neck finish and having:

a sealing lip facing axially outwardly and extending substantially perpendicular to the central longitudinal axis, an outward lip facing radially and axially outwardly, a retention lip facing axially inwardly and radially outwardly and extending between the outward lip and the radially outer surface of the wall, a first rounded surface extending between the sealing lip and the outward lip, and a second rounded surface extending between the outward lip and the retention lip; and a filleted surface extending between the retention lip and the radially outer surface of the wall, wherein a ratio of a major outer diameter of the outward lip of the rim relative to an inner diameter of the radially inner surface is between 1.1:1 and 1.3:1, wherein a ratio of the major outer diameter relative to an outer diameter of the radially outer surface of the neck finish is between 1.03:1 and 1.07:1, and wherein a ratio of an axial thickness of the rim at the major outer diameter relative to a radial thickness of the rim between the major outer diameter and an outer diameter of the radially outer surface is between 0.9:1 and 1.2:1.

15. The glass container set forth in claim 14, wherein the outward lip of the rim has a straight taper disposed at an angle between two and six degrees with respect to an axis parallel to the longitudinal axis, and wherein the retention lip of the rim has a straight taper disposed at an angle between 68 and 87 degrees with respect to an axis parallel to the longitudinal axis A.

16. The glass container set forth in claim 14, wherein the rim of the neck finish also includes a mouth transition lip extending radially inwardly of the sealing lip, wherein the mouth transition lip has a radius between 1.6% and 2.2% of the major outer diameter of the outward lip, wherein the first rounded surface has a radius between 1.3% and 3.4% of the major outer diameter of the outward lip, wherein the second rounded surface has a radius between 0.9% and 1.1% of the major outer diameter of the outward lip, and wherein the filleted surface has a radius between 1.3% and 2.2% of the major outer diameter of the outward lip.

17. A package comprising:

the glass container set forth in claim 14; and a ring pull cap closure coupled to the container rim, wherein the ring pull cap closure includes a metal outer portion and a polymeric inner portion, wherein the metal outer portion includes a base wall, and a skirt wall extending from the base wall and including a cylindrical portion spaced from and surrounding the outward lip and a crimped portion overlapping and contacting at least a portion of the retention lip.

18. A glass container, comprising:

a base; and a sidewall extending away from the base, circumscribing a central longitudinal axis, and including a neck finish terminating the side wall, wherein the neck finish includes:

a wall having a radially inner surface and a radially outer surface;

a rim extending from the wall and terminating the neck finish and having:

a sealing lip facing axially outwardly and extending substantially perpendicular to the central longitudinal axis, an outward lip facing radially and axially outwardly, a retention lip facing axially inwardly and radially outwardly and extending between the outward lip and the radially outer surface of the wall, a mouth transition lip extending radially inwardly of the sealing lip, a first rounded surface extending between the sealing lip and the outward lip, and a second rounded surface extending between the outward lip and the retention lip; and a filleted surface extending between the retention lip and the radially outer surface of the wall, wherein the outward lip of the rim has a straight taper disposed at an angle between two and six degrees with respect to an axis parallel to the longitudinal axis, wherein the retention lip of the rim has a straight taper disposed at an angle between 68 and 87 degrees with respect to an axis parallel to the longitudinal axis, wherein the mouth transition lip has a radius between 1.6% and 2.2% of a major outer diameter of the outward lip of the rim, wherein the first rounded surface has a radius between 1.3% and 3.4% of the major outer diameter of the outward lip, wherein the second rounded surface has a radius between 0.9% and 1.1% of the major outer diameter of the outward lip, and wherein the filleted surface has a radius between 1.3% and 2.2% of the major outer diameter of the outward lip.

19. The glass container set forth in claim 18, wherein a ratio of the major outer diameter relative to an inner diameter of the radially inner surface is between 1.1:1 and 1.3:1, wherein a ratio of the major outer diameter relative to an outer diameter of the radially outer surface of the neck finish is between 1.03:1 and 1.07:1, and wherein a ratio of an axial thickness of the rim at the major outer diameter relative to a radial thickness of the rim between the major outer diameter and an outer diameter of the radially outer surface is between 0.9:1 and 1.2:1.

20. A package comprising:

the glass container set forth in claim 17; and a ring pull cap closure coupled to the container rim, wherein the ring pull cap closure includes a metal outer portion and a polymeric inner portion, wherein the metal outer portion includes a base wall, and a skirt wall extending from the base wall and including a cylindrical portion spaced from and surrounding the outward lip and a crimped portion overlapping and contacting at least a portion of the retention lip.

* * * * *